US007806747B2

(12) United States Patent
Duncan

(10) Patent No.: US 7,806,747 B2
(45) Date of Patent: Oct. 5, 2010

(54) TOY LAWN MOWER

(75) Inventor: Edward C. Duncan, Cranston, RI (US)

(73) Assignee: Hasbro, Inc., Pawtucket, RI (US)

( * ) Notice: Subject to any disclaimer, the term of this patent is extended or adjusted under 35 U.S.C. 154(b) by 291 days.

(21) Appl. No.: 11/091,019

(22) Filed: Mar. 25, 2005

(65) Prior Publication Data

US 2006/0217028 A1 Sep. 28, 2006

(51) Int. Cl.
*A63H 3/20* (2006.01)

(52) U.S. Cl. ..... 446/330; 446/269; 446/411

(58) Field of Classification Search ..... 446/269–294, 446/411, 330, 175; 74/47, 48, 49, 50, 53, 74/54, 55, 567
See application file for complete search history.

(56) References Cited

U.S. PATENT DOCUMENTS

| | | | | | |
|---|---|---|---|---|---|
| 2,251,006 | A | * | 7/1941 | Savage | 446/277 |
| 2,379,376 | A | * | 6/1945 | Rau | 446/283 |
| 2,781,609 | A | | 2/1957 | Allen | |
| 3,292,300 | A | | 12/1966 | Lescher et al. | |
| 3,435,555 | A | * | 4/1969 | Sammis | 446/289 |
| 4,222,195 | A | * | 9/1980 | Kurosawa et al. | 446/289 |
| 4,236,346 | A | * | 12/1980 | Iwao | 446/294 |
| 4,295,294 | A | | 10/1981 | Rosenwinkel et al. | |
| 4,333,259 | A | * | 6/1982 | Pin-Huang | 446/177 |
| 4,516,951 | A | * | 5/1985 | Saigo et al. | 446/338 |
| 4,693,697 | A | * | 9/1987 | Pagano | 446/272 |
| RE32,973 | E | | 7/1989 | Panzarella | |
| D312,668 | S | | 12/1990 | Klawitter | |
| D312,671 | S | | 12/1990 | Klawitter | |
| 5,163,863 | A | * | 11/1992 | Goldfarb et al. | 446/236 |
| 5,334,078 | A | * | 8/1994 | Hippely et al. | 446/470 |
| 6,227,931 | B1 | * | 5/2001 | Shackelford | 446/268 |
| 2002/0102908 | A1 | * | 8/2002 | Chan | 446/269 |

FOREIGN PATENT DOCUMENTS

| | | | |
|---|---|---|---|
| FR | 2597002 | A1 * | 10/1987 |
| GB | 2109255 | A | 6/1983 |

* cited by examiner

*Primary Examiner*—Gene Kim
*Assistant Examiner*—Urszula M Cegielnik
(74) *Attorney, Agent, or Firm*—Marshall, Gerstein & Borun LLP

(57) ABSTRACT

A toy lawn mower includes a chassis having a first end and a second end and supported by a plurality of rotatable wheels, an animated figure or body section mounted to the chassis and arranged to shift between an unshifted position in which the animated figure is disposed toward the first end and a first shifted position in which the animated figure is rotated and shifted toward the second end, and a drive train operatively coupling the animated figure to at least one of the wheels such that the animated figure is movable between the unshifted position and the first shifted position in response to rotation of the at least one wheel.

20 Claims, 12 Drawing Sheets

TOY LAWN MOWER

FIELD OF THE INVENTION

The present invention relates generally to a toy lawn mower and, more particularly, to a toy lawn mower carrying an animated figure that simulates a chomping action as the toy lawn mower is moved over a support surface.

BACKGROUND OF THE INVENTION

Toy lawn mowers are generally known in the art. For example, U.S. Pat. No. Re. 32,973 to Panzarella discloses a toy bubble-blowing lawn mower having a wheel driven impeller coupled to a propeller for generating a stream of air. A disk covered by a bubble-forming liquid film is in alignment with the stream of air such hat bubbles can be generated. U.S. Pat. No. Des. 312,668 discloses a toy lawn mower bearing an image. U.S. Pat. No. 3,292,300 to Lescher et al. discloses a toy lawn mower having visible reciprocating pistons, while U.S. Pat. No. 4,295,294 to Rosenwinkel et al. and U.K. Patent No. GB 2109255 both disclose toy lawn mowers with simulated grass clippings.

SUMMARY OF THE INVENTION

In accordance with an exemplary aspect of the invention, a toy lawn mower includes a chassis having a first end and a second end and supported by a plurality of rotatable wheels, an animated figure mounted to the chassis and arranged to shift between an unshifted position in which the animated figure is disposed toward the first end and a first shifted position in which the animated figure is rotated and shifted toward the second end, and a drive train operatively coupling the animated figure to at least one of the wheels such that the animated figure is movable between the unshifted position and the first shifted position in response to rotation of the at least one wheel.

In further accordance with a preferred embodiment, the animated figure is shiftable to a second shifted position, and the drive train also is arranged to shift the body to the second shifted position. A sound generator connectable to a power source may be included, and including an actuator arranged to activate the sound generator. A lever may be mounted to an axle and arranged to contact the actuator in response to movement of the toy lawn mower over a support surface. A chamber may be provided and arranged to house simulated grass clippings, and including an agitator bar arranged to agitate the clippings in response to movement of the toy lawn mower over a support surface.

A top portion of the chassis may include or define a receiving area, and the drive train is arranged so that the animated figure is disposed over the receiving area when the animated figure is in the unshifted position and so that at least a part of the animated figure is raised above the receiving area and is moved toward one of the ends when the animated figure is shifted to the first shifted position. The drive train may be arranged to shift the animated figure to a second shiftable position, and the receiving area may includes a horizontal surface, and the animated figure is arranged to slide along the horizontal surface in response to movement of the animated figure from the second shifted position toward the unshifted position. Preferably, the chassis includes a guide track and the animated figure includes an arm sized to engage the guide track.

In accordance with another aspect of the invention, a lawn mower may include a chassis supported by a plurality of rotatable wheels, a guide track operatively coupled to the chassis, an animated figure including an arm operatively engaging the guide track and arranged to shift along a path between a plurality of positions, a drive train responsive to movement of one of the rotatable wheels, and a drive lever operatively interconnecting the drive train to the animated figure, with the drive lever arranged to reciprocate along a path disposed in a vertical plane, and with the animated figure movable to the plurality of positions in response to movement of the drive lever.

In accordance with a still further exemplary aspect of the invention, a toy lawn mower includes a chassis supported by a plurality of rotatable wheels, a guide track operatively coupled to the chassis and arranged to shift along a path between a plurality of positions, a body section including an arm operatively engaging the guide track, a drive train responsive to movement of one of the rotatable wheels, a drive lever operatively interconnecting the drive train and the body section, with the drive lever arranged to reciprocate forward and rearward in response to movement of the drive train, the body section movable to the plurality of positions in response to movement of the drive lever, and wherein the guide track is arranged to define an unshifted position in which the body section is disposed toward a rear end of the chassis, a first shifted position in which the body section is rotated about a transverse horizontal axis and is shifted toward a front end of the chassis, and a second shifted position in which a lower plane of the body section is disposed parallel to an upper plane of the chassis with the body section disposed toward the front end of the chassis.

DETAILED DESCRIPTION OF THE INVENTION

Although the following text sets forth a detailed description of an exemplary embodiment of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
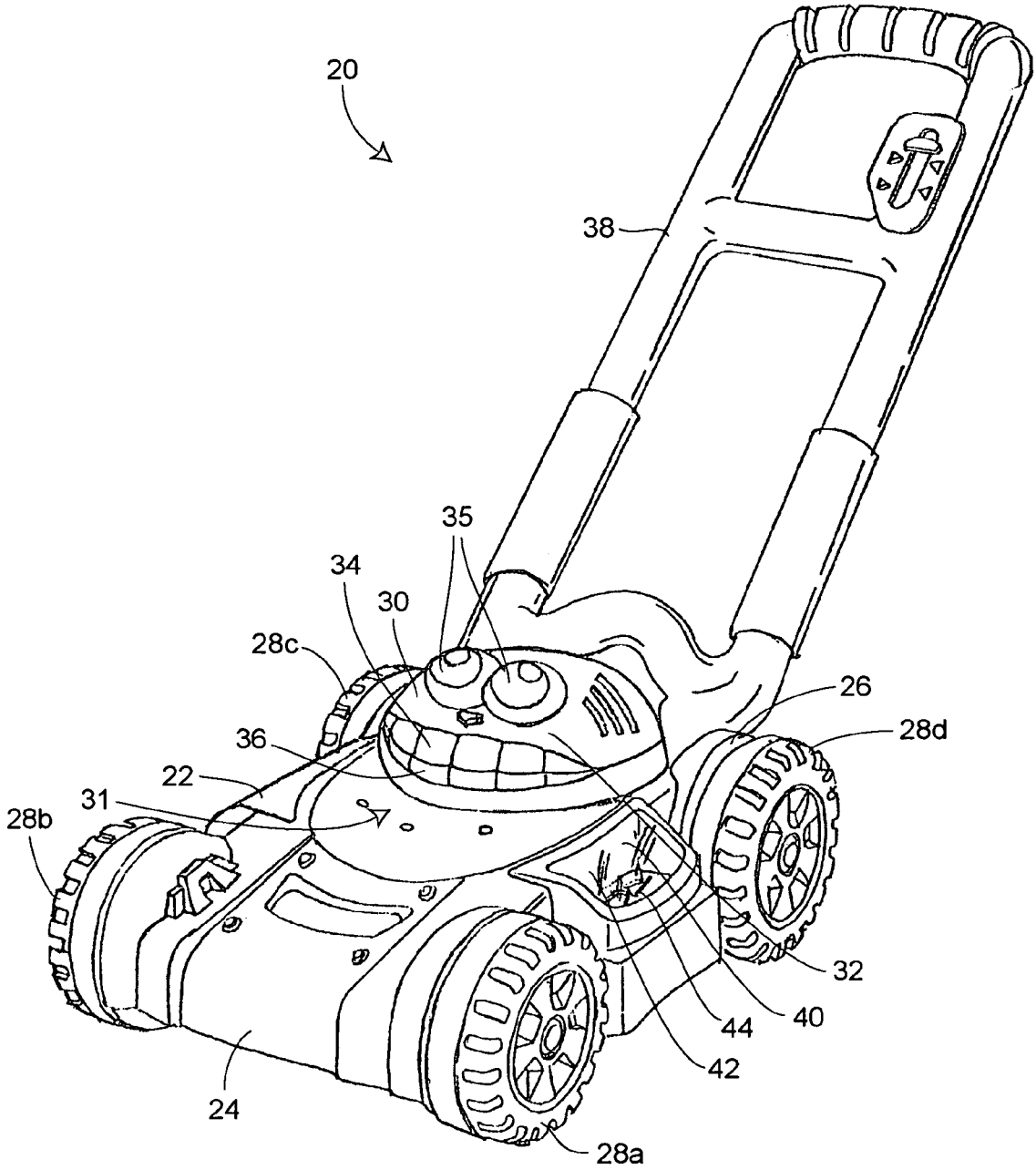
FIG. 1 is a front perspective view of a toy lawn mower assembled in accordance with the teachings of the present invention.
Figure 2:
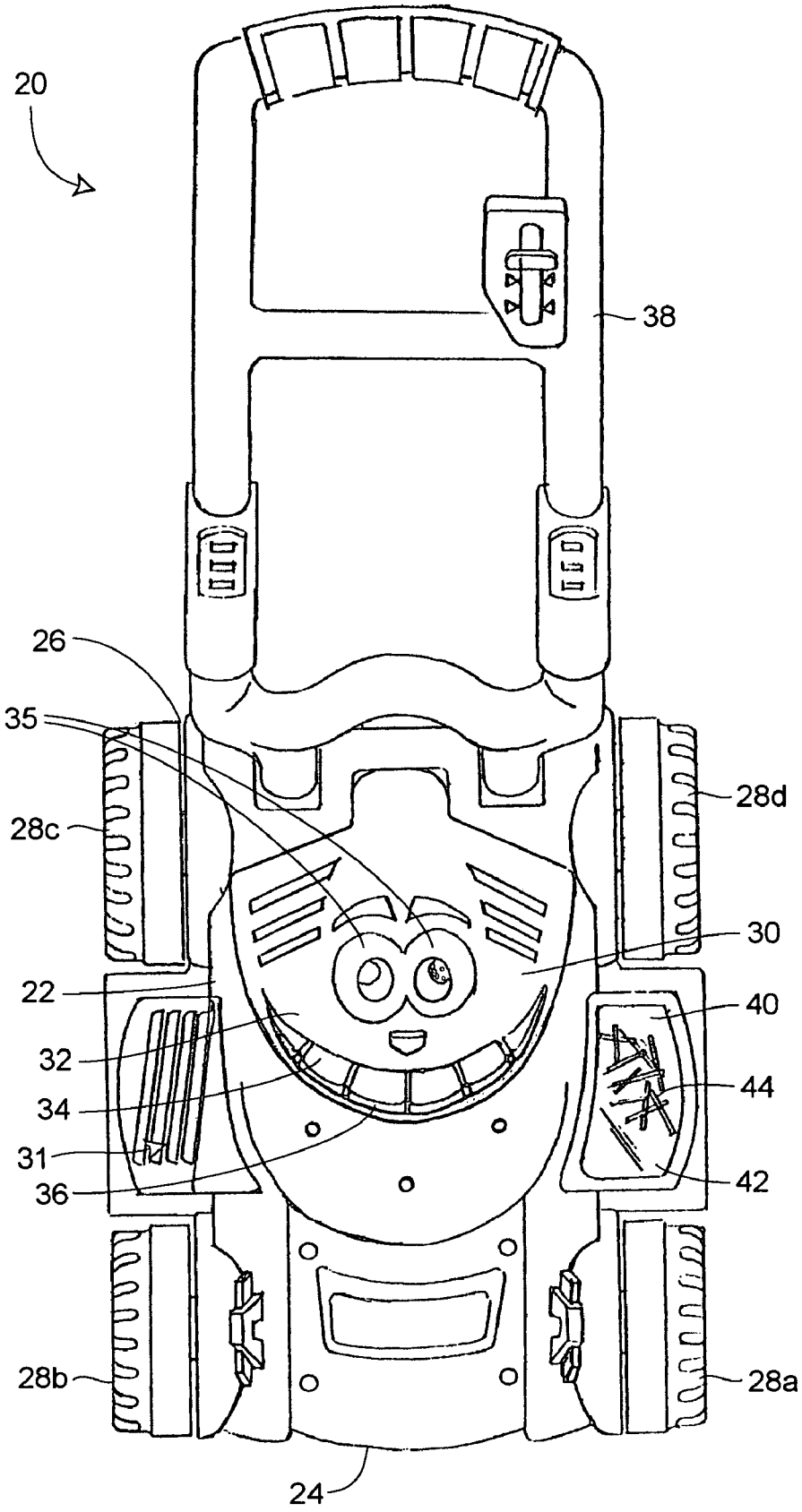
FIG. 2 is a top plan view thereof.
Figure 3:
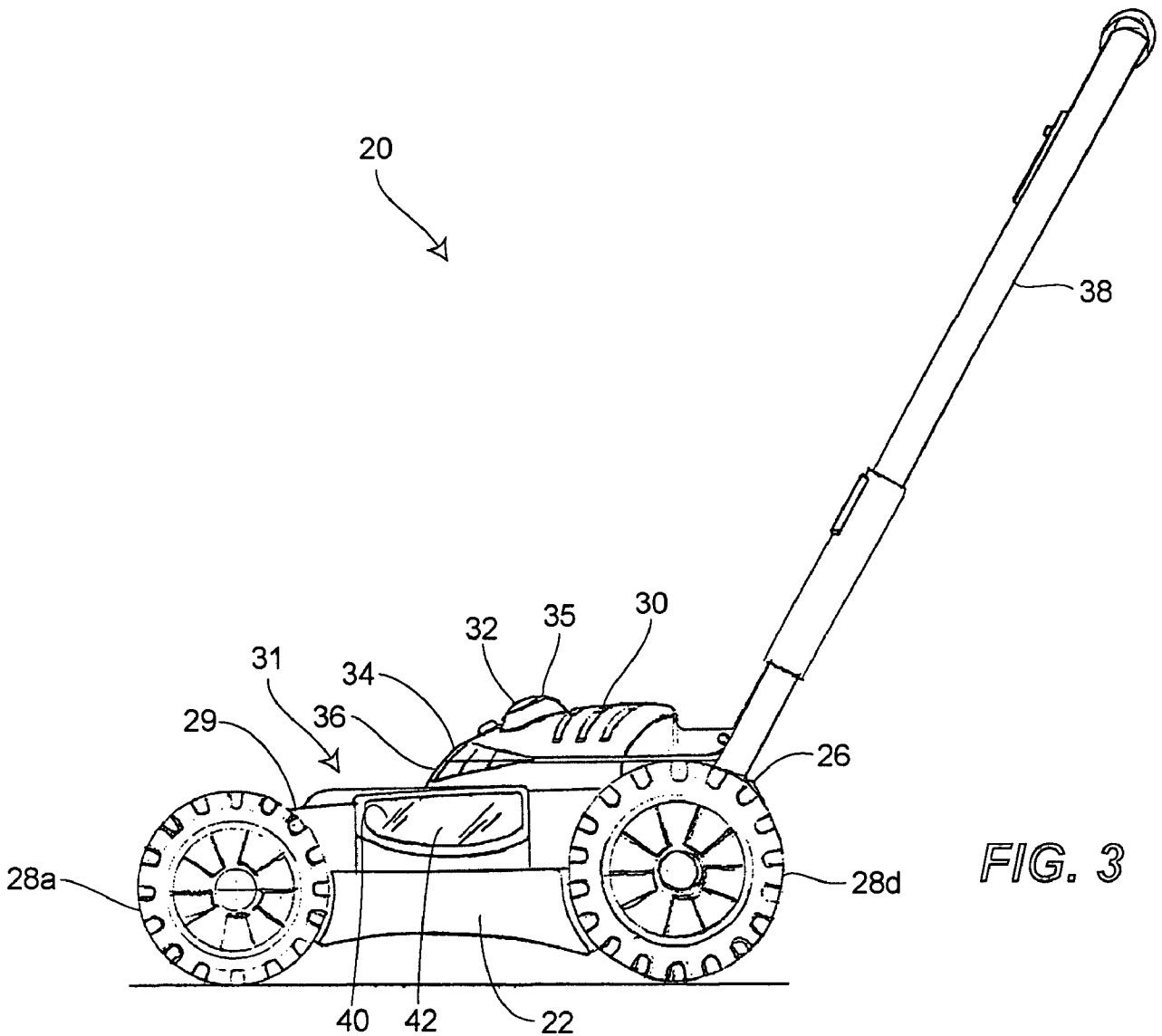
FIG. 3 is a side elevational view thereof.

Referring now to the drawings, FIGS. 1-3 illustrate a toy lawn mower assembled in accordance with the teachings of the present invention and generally referred to by the reference numeral 20. The toy lawn mower 20 includes a chassis 22 having a front end toy for any rear end 26, all of which are supported for rolling movement over a support surface by a plurality of wheels 28*a*, 28*b*, 28*c* and 28*d*. The chassis 22 is, in accordance with the disclosing sample, constructed to appear similar to an actual lawn mower. A body section 30 is mounted to the chassis 22 in a manner to be described in greater detail below. In accordance with the disclosed example, a portion of the body section 30 and/or a portion of the chassis may be constructed to form all or at least a portion of an animated FIG. 31. In accordance with the disclosed example, the animated FIG. 31 includes a face 32, with the face 32 preferably including a mouth or teeth 34 and/or eyes 35. The face 32 may take the form of that shown, and other animated features may be included. Alternatively, the face itself may be omitted, with the toy lawn mower instead appearing in a manner similar to a real lawn mower. A portion of the chassis 22 may include teeth 36 which complement the teeth 34 carried by the body section 30. The toy lawn mower 20 may also be provided with a suitable handle 38.

Preferably, the chassis 22 will also include a chamber 40 having a transparent cover 42, with a chamber sized to receive a plurality of simulated grass clippings 44. The toy lawn mower 20 also includes a drive train 46, which is illustrated in greater detail in FIGS. 4-10, such that the body section 30 (and hence all or at least a portion of the animated FIG. 31) will shift between a plurality of positions in response to rotation of at least one of the wheels 28*a*-28*d*, as will be explained in greater detail below.

Referring now to FIGS. 4-7, the body section 30 includes an arm 47 which extends through a suitably sized slot or similar aperture 48 in an upper portion 50 of the chassis 22. In accordance with the disclosed example, the upper portion 50 is generally planar, and the slot 48 extends generally parallel to a longitudinal axis A. A guide track 52 is mounted inside the chassis 22 and defines a generally continuous path 54. A lower portion 56 of the arm 47 includes a transverse pin 58, which is sized to fit within the guide track 52 so as to follow the path 54 as will be explained in greater detail below. A drive lever 60 includes an upper end 60*a* mounted to a rear end 62 of the body section 30, and also includes a lower end 60*b*. The lower end 60*b* includes a slot 64, and is mounted to the chassis 22 by a mounting screw 66. The lever 60 also includes a central slot 68. A rotatable drive wheel 70, which is responsive to movement of the drive train 46, includes a pin 72 sized to engage the slot 68 in the drive lever 60.

Figure 4:
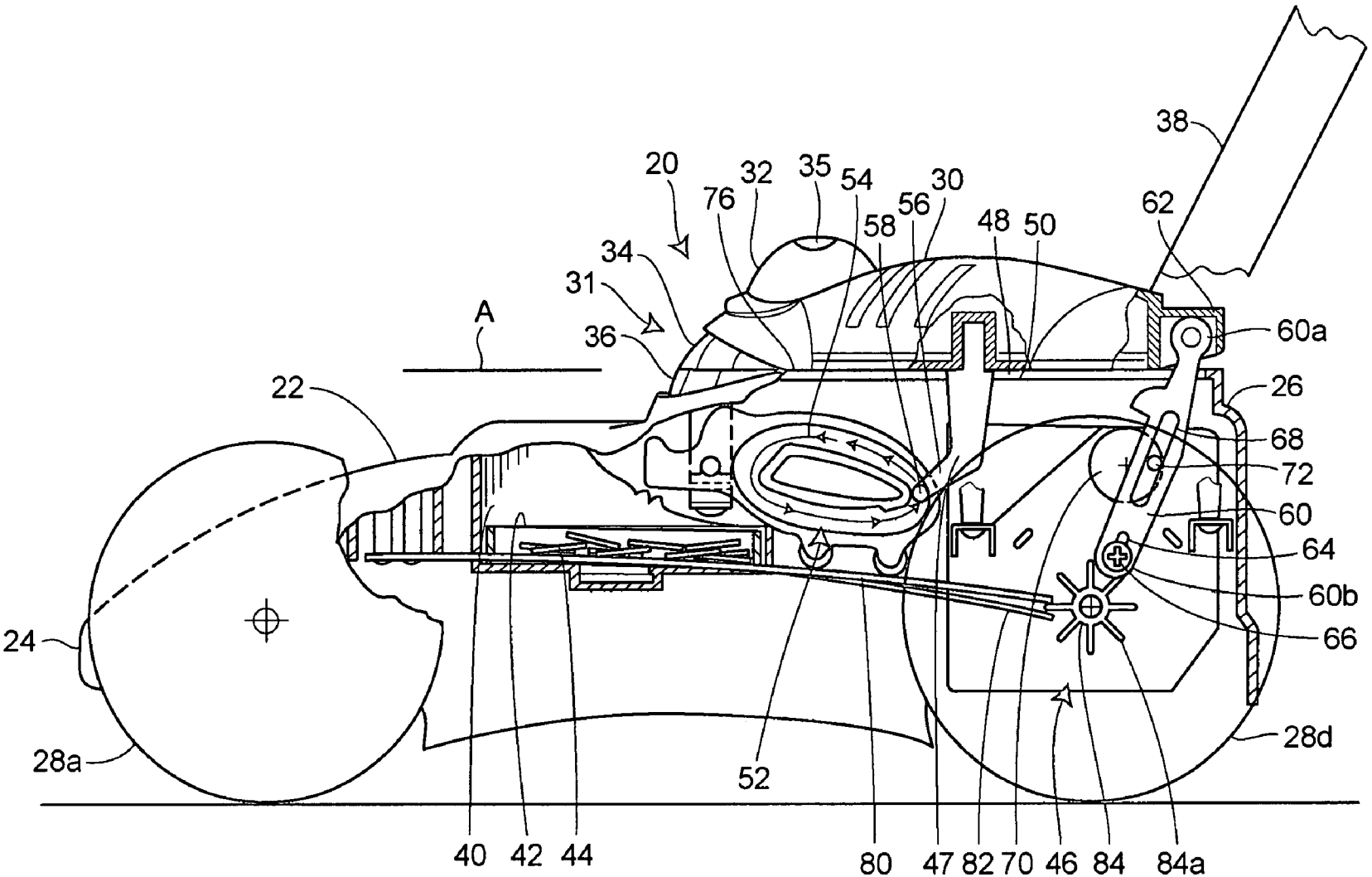
FIG. 4 is an enlarged fragmentary cross-sectional view illustrating portions of the drive train and the shiftable part of the body, with the shiftable part of the body shown in an exemplary unshifted position.

The upper portion 50 of the chassis 22 includes a receiving area 74. When positioned in an unshifted position as shown in FIG. 4, a lower surface 76 of the body section 30 is disposed on top of and generally parallel to the receiving area 74. Also, when the body section 30 is the unshifted position, it can be seen that the teeth 36 are generally aligned with the teeth 34. It will also be noted that the rear end 62 of the body section 30 is disposed generally toward the rear end 26 of the chassis 22.

An agitator bar 80 is mounted to the chassis 22 and extends through a chamber 40. An end 82 of the agitator bar 80 extends to engage a wheel 84 having a plurality of projections 84*a*. The wheel 84 is responsive to rotation all at least one of the wheels 28*a*-28*d*. Accordingly, in response to rotation all of the wheel 84, the agitator bar 80 will oscillate up-and-down in response to contact with each of the projections 84*a*. The up-and-down oscillating motion of the agitator bar 80 in turn agitates the simulated grass clippings 44 contained within the chamber 40.

Figure 5:
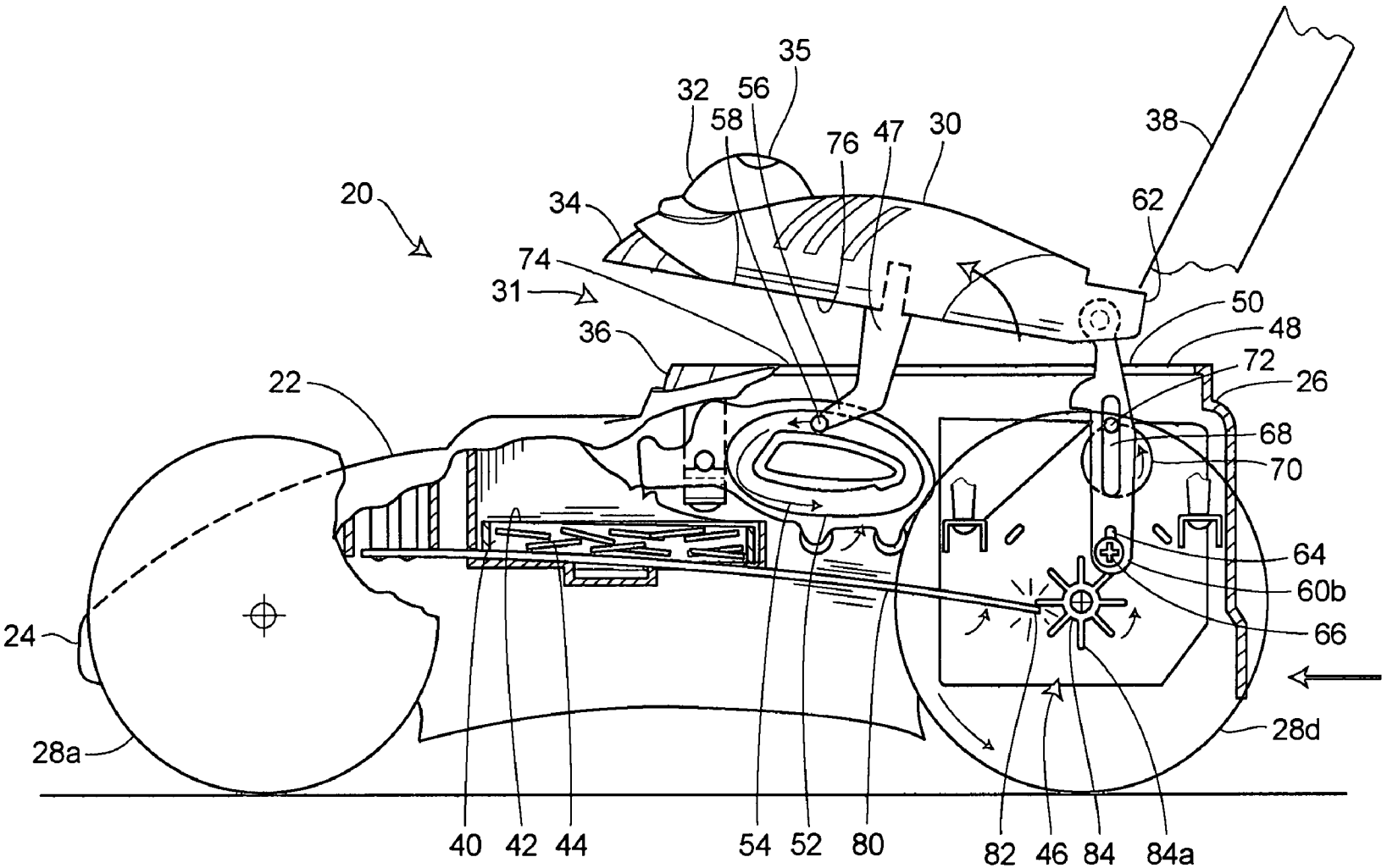
FIG. 5 is an enlarged fragmentary cross-sectional similar to FIG. 4 and illustrating the shiftable part of the body in an exemplary shifted position.

Referring now to FIG. 5, the drive wheel 70 has rotated in response to movement of the drive train 46, such that the pin 72 has forced the drive lever 60 to put it about the screw 66. Movement of the drive lever 60 in the forward direction (toward the left when viewing the Figure) in turn causes the body section 30 to shift in the forward direction. Because the arm 47 is guided within the guide track 52 by the pin 58, it forward portion 84 of the body section 30 is raise off the chassis 22 two to the fact that the entire body section 30 has rotated about the pivot 62. Thus, in the first shifted position illustrated in FIG. 5, the body section 30 has shifted in the forward direction, and has rotated about the pivot 62. It will be appreciated that the pin 58 of the arm 47 is carried on in upper portion of the guide track 52 when the body section 30 is disposed in the position of FIG. 5.

Figure 6:
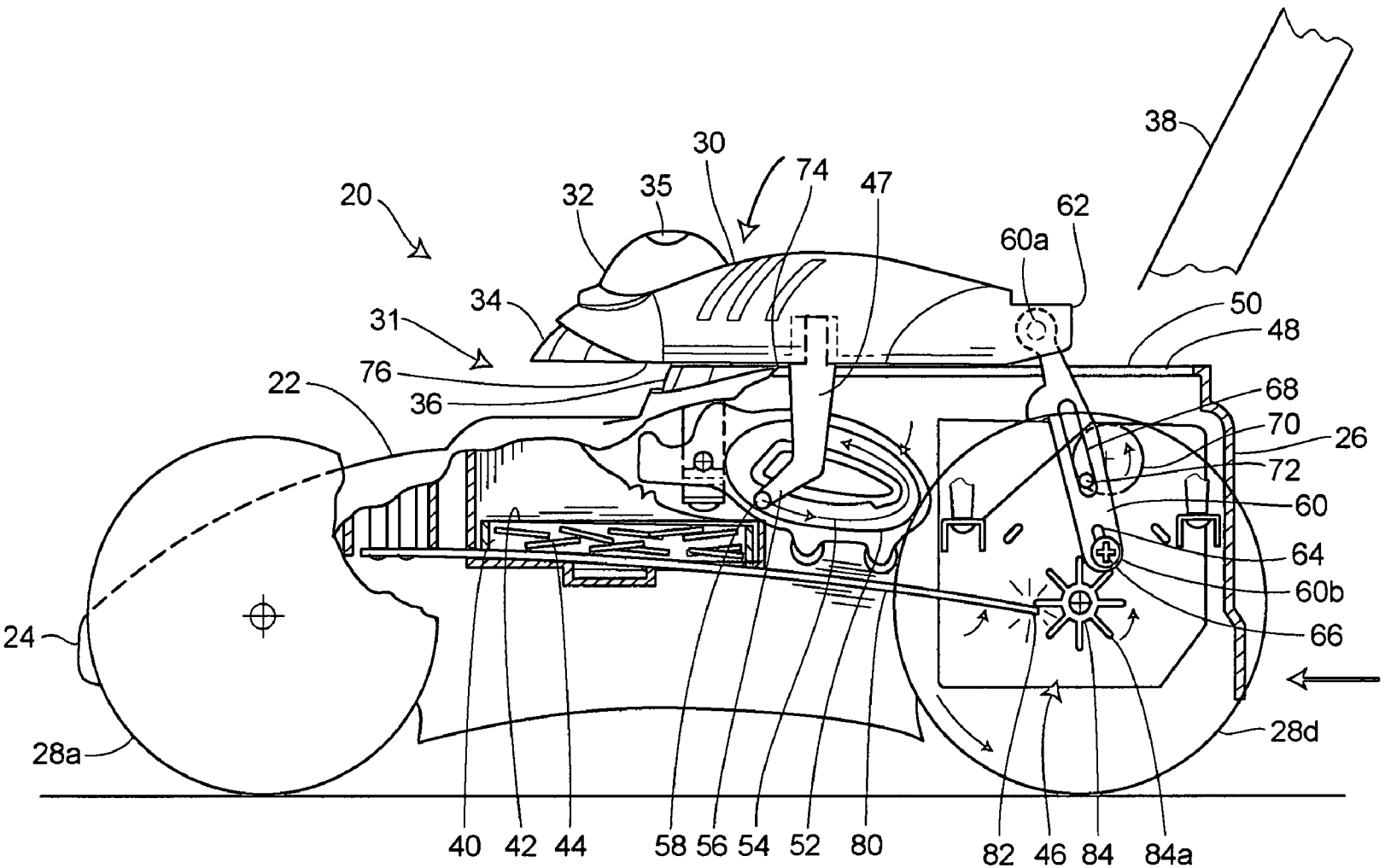
FIG. 6 is another enlarged fragmentary cross-sectional view similar to FIGS. 4 and 5 and illustrating the shiftable part of the body in another exemplary shifted position.

Referring now to FIG. 6, in response to continued rotation of the drive wheel 70, the drive lever 60 has shifted further forward. In response, arm 47 has continued around the past 54 defined by the guide track 52 and now resides in a lower portion of the guide track 52. Accordingly, the front end of the body section 30, including the teeth 34, has dropped down and is now once again generally parallel to the receiving area 74. However, it will be noted that the body section 30 is disposed forwardly relative to its positioned in FIG. 4, and the rear end 62 of the body section 30 is now spaced away from the rear end 26 of the chassis 22.

Figure 7:
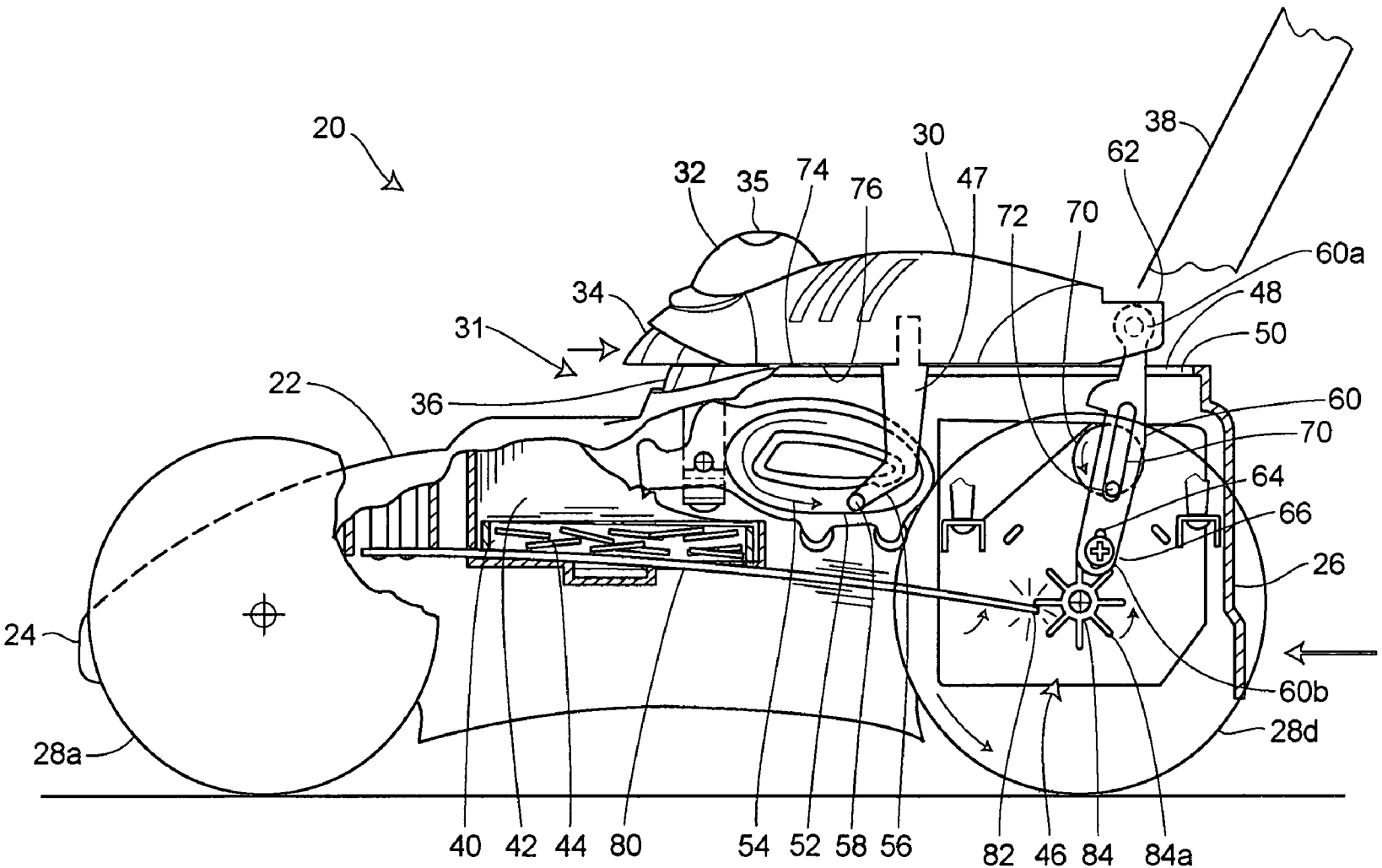
FIG. 7 is yet another enlarged fragmentary cross-sectional view similar to FIGS. 4-6 and illustrating the shiftable part of the body returning from the shifted position all of FIG. 6 back toward the unshifted position of FIG. 4.

As shown in FIG. 7, in response to continued rotation of the drive wheel 70, the drive lever 60 has now begun to shift in a rearward direction as it pivots about the screw 66, and consequently the body section 30 slides along the receiving area 74. Eventually, the body section 30 will reach the unshifted position of FIG. 4.

Figure 8:
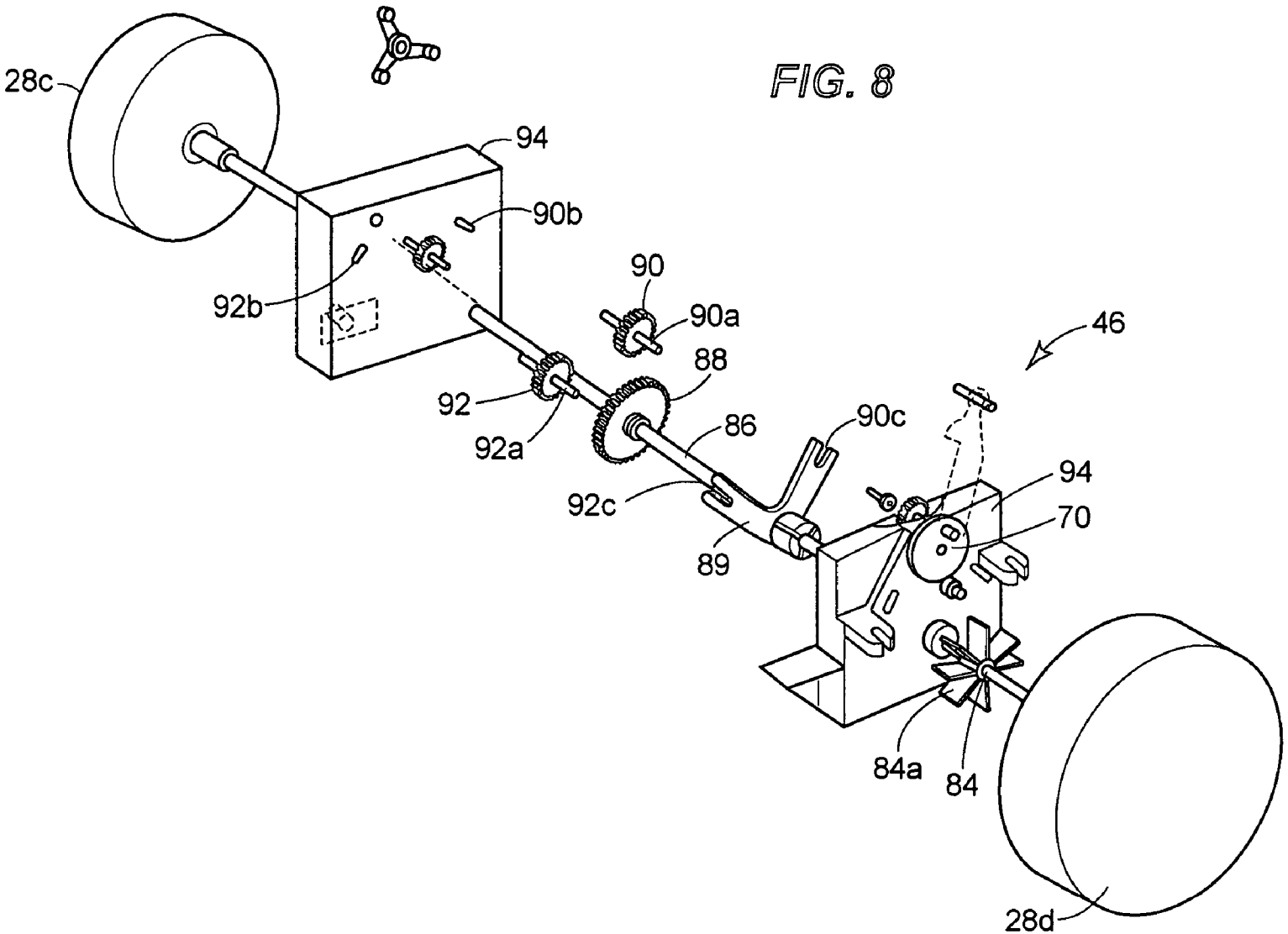
FIG. 8 is an enlarged fragmentary exploded view illustrating components of the drive train operatively coupling or one or more of the drive wheels to the shiftable body part.

Referring now to FIG. 8, the drive train 46 is shown. A pair of the wheels, 28*c* and 28*d*, are mounted to an axle 86. Preferably, the wheel 84 is also mounted to the axle 86. A gear 88 and a V lever 89 are mounted to the axle, with the gear 88 preferably being rigidly mounted to the axle 86. The drive train 46 includes a first drive gear 90 and a second drive gear 92. The V lever 89 is preferably friction-mounted to the axle 86, such that the V lever 89 will rotate as the axle 86 rotates, but the axle 86 will continue to rotate in the event the lever 89 encounters resistance, such as an obstruction. The gears 90 and 92 preferably each include a pin 90*a* and 92*a*, respectively. A housing 94 includes guide slots 90*b* and 92*b*, respectively. The lever 89 also includes a pair of slots 90*c* and 92*c*, with the slots 90*c* and 92*c* also sized to receive the pins 90*a* and 92*a*. The drive wheel 70 is preferably rotationally mounted to or within the housing 94. The drive wheel 70 includes a gear 96 (best viewed in FIGS. 9 and 10).

Figure 9:
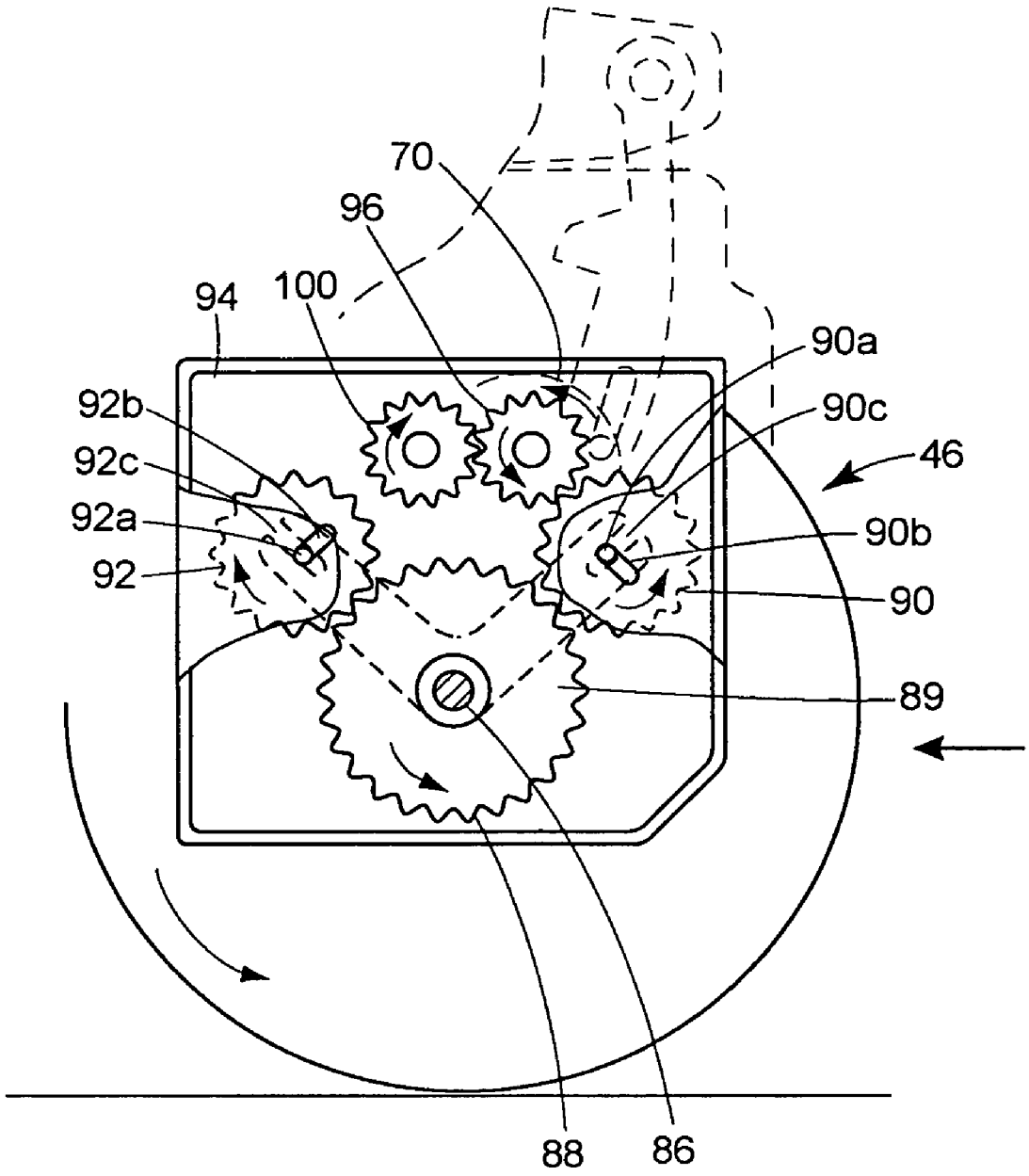
FIG. 9 is an enlarged fragmentary view, partly in section, of portions of the drive train and illustrating the drive train in a position caused by forward motion of the toy lawn mower.

Referring now to FIG. 9, in response to movement of the toy lawnmower 20 in the forward direction as indicated toward the left of FIG. 9, the wheels 28*c* and 28*d* will rotate in a counterclockwise direction as shown. In response to such rotation, the lever 89 will initially rotate in a counterclockwise direction. The pins 90*a* and 92*a* shift within by their respective slots 90*b* and 92*b* in response to movement of the lever 89 in the counterclockwise direction, as the slots 90*c* and 92*c* of the lever 89 bear against the pins 90*a* and 92*a*. This movement brings the first gear 90 into contact with the gear 96 of the drive wheel 70. Therefore, rotation of the gear 88 is transmitted to the gear 96 of the drive wheel 70 via the first gear 90. This causes the drive wheel 70 to rotate in the counterclockwise direction indicated. Consequently, the drive lever 60 shifts back and forth, pivoting about the screw 66, as described above.

Figure 10:
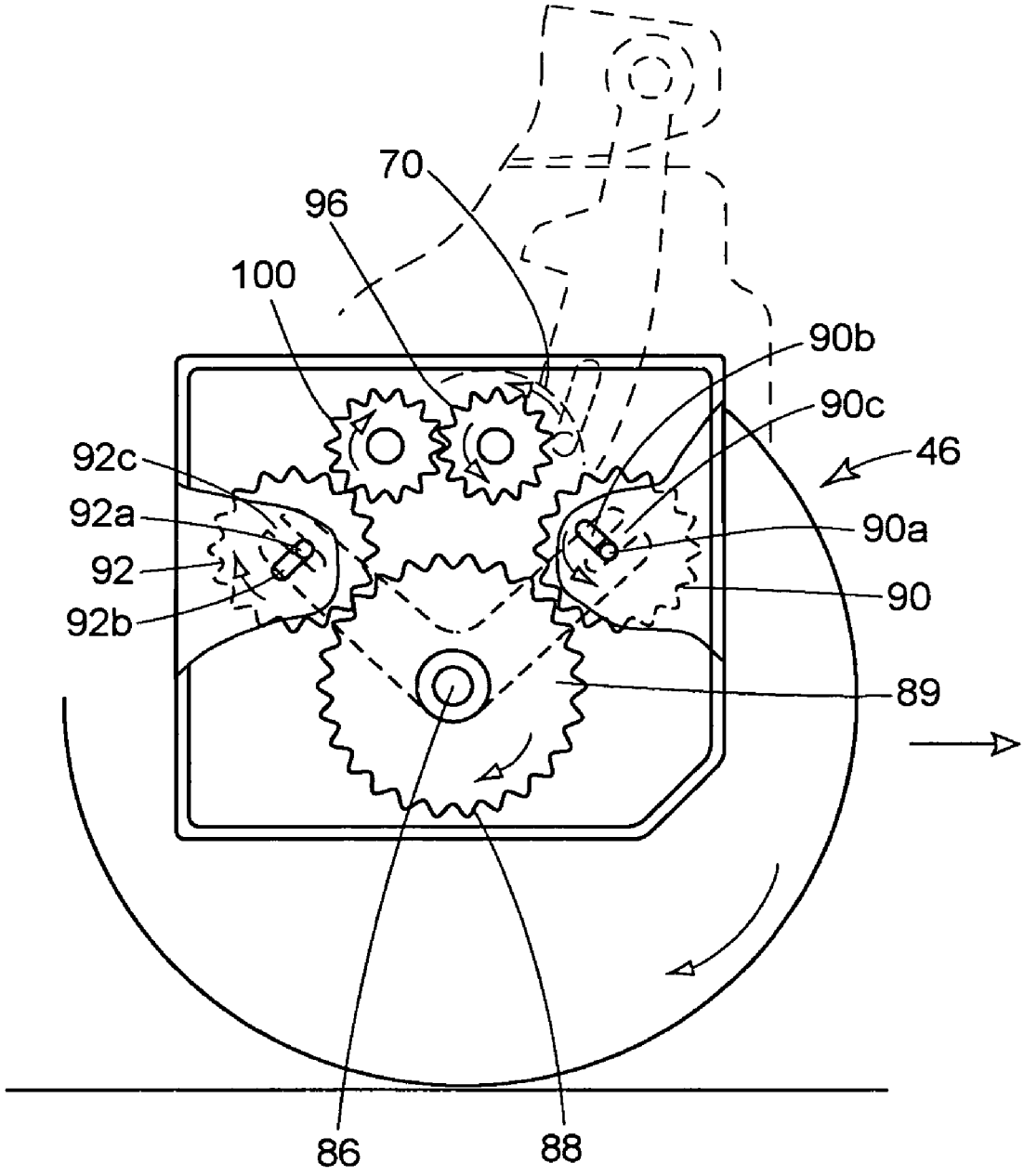
FIG. 10 is an enlarged fragmentary view, partly in section, similar to FIG. 9 and illustrating the drive train in a position caused by rearward motion of the toy lawn mower.
Figure 11:
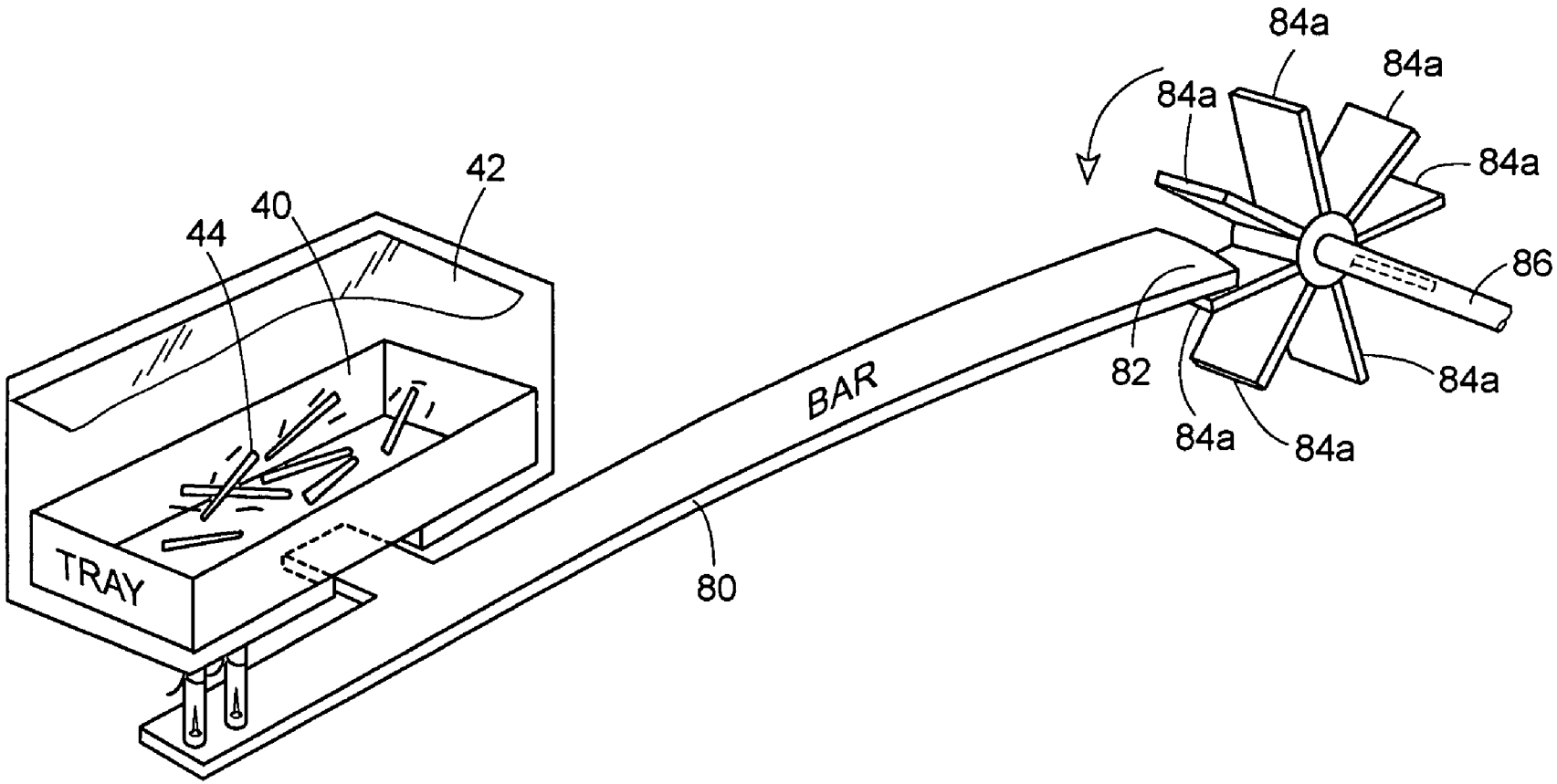
FIG. 11 is an enlarged fragmentary view in perspective illustrating an agitator bar operatively connected to a container of simulated grass clippings.

Referring now to FIG. 10, when the toy lawnmower 20 is moved in a rearward direction as indicated, the wheels 28*a* and 28*b* rotate in the clockwise direction shown. This rotation causes the gear 88 and axle 86 to likewise rotate in the clockwise direction. The V lever 89 rotates in the clockwise direction, until the pins 90*a* and 92*a* contact the ends of their respective slots. It will be noted that, in response to the movement of the V lever 89, the first gear 90 is brought out of engagement with the gear 96 of the drive wheel 70. On the other hand, the second gear 92 is now brought into engagement with an idler gear 100 (FIGS. 9 and 10), which is in engagement with the gear 96 of the drive wheel 70. Consequently, clockwise rotation of the wheels 28*c* and 28*d*, and clockwise rotation of the gear 88, results in counterclockwise rotation of the drive wheel 70. It will be noted that, in the preferred example, the drive wheel 70 rotates in the counterclockwise direction when the toy lawnmower 20 is moved in a forward direction and when the toy lawnmower is moved in a reward direction. Once again, as described above, rotation of the drive wheel 70 causes drive lever 60 to moved back and forth as it pivots about the mounting screw 66, which causes the above-described movement of the body section 30 relative to the chassis 22. In accordance with the disclosed example, this back-and-forth movement of the body section 30, with the forward portion of the body section 30 moving up-and-down as the entire body section 30 slides foreword and rearward, simulates a "chomping" action.

Figure 12:
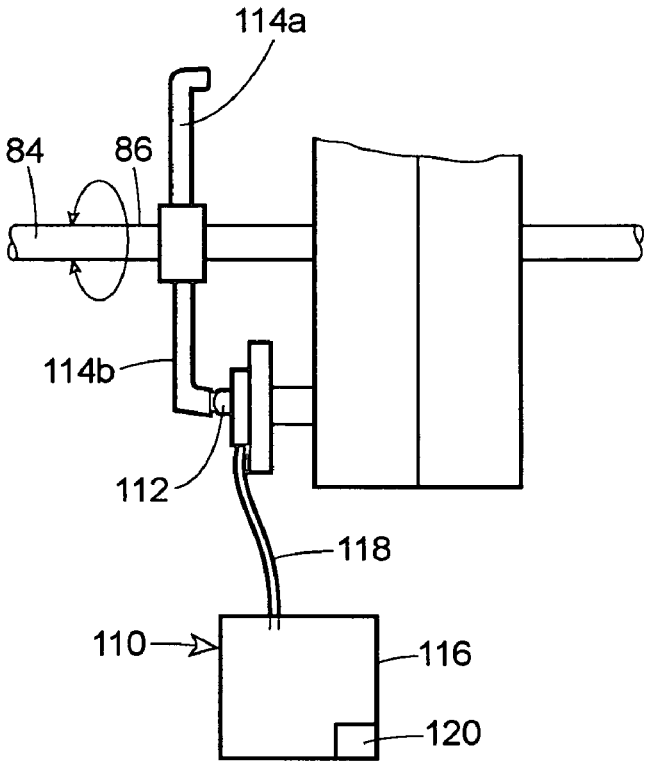
FIG. 12 is an enlarged fragmentary elevation view illustrating an activator for activating a switch operatively coupled to a sound generator, with the sound generator shown schematically.
Figure 13:
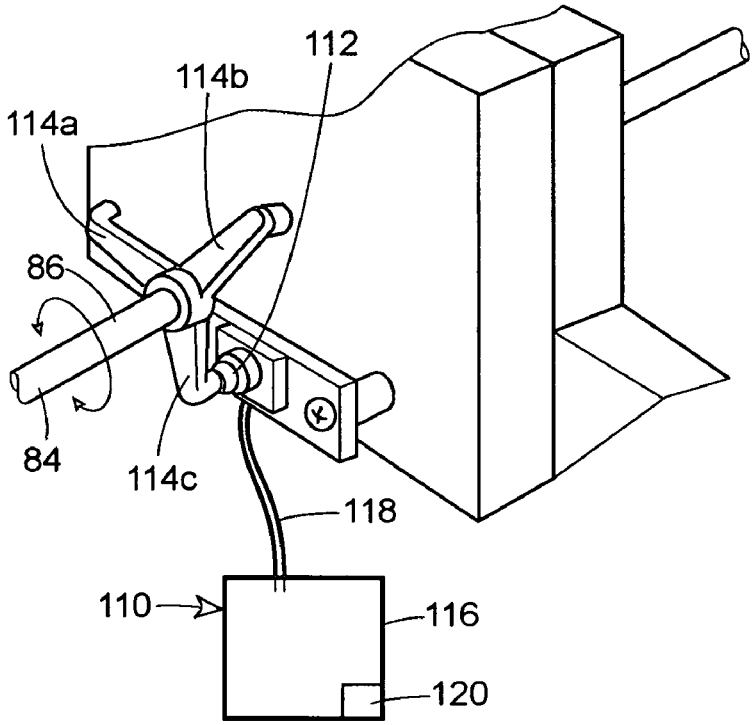
FIG. 13 is a perspective view of the activator and sound generator illustrated in FIG. 12.

Referring now to FIGS. 12 and 13, a sound module 110 is mounted within the chassis 22. An actuator button 112 is mounted within the chassis 22 in a position to be contacted by an actuator 114. The actuator 114, in accordance with the disclosed example, includes three arms 114*a*, 114*b* and 114*c*, all of which extend radially outwardly from the axle 86. Consequently, in response to rotation of the axle 86, each of the arms 114*a*, 114*b* and 114*c* will, in succession, come into contact with the actuator button 112. In accordance with the disclosed example, it will be appreciated that the sound module 110 will be arranged to output sounds that simulate lawn mower sounds, and/or to output words or phrases that may be associated with lawn mowing, or to output any other suitable sounds or phrases.

The sound module 110 includes a sound generator 116 operatively connected to the actuator button 112 by an electrical circuit 118. The sound module 110 also includes a power source 120 which, in the disclosed example, is a battery. Other power sources may prove suitable as would be known in the art. The sound generator 116 may be any electronic or electro-mechanical device capable of outputting desired sound programmed or stored therein. For example, the sound generator 116 may include a controller implemented on a circuit board and containing the control logic and sound generation data implemented via circuitry contained on a conventional printed circuit board, with the control logic and sound generation data being stored directly on the printed circuit board. It should also be appreciated that although the controller may be implemented on a printed circuit board, more complex implementations of the sound generator 116 may be implemented wherein the controller may comprise, among other components, a program memory, a microcontroller or microprocessor (MP), a random-access memory (RAM), read-only member (ROM), and an input/output (I/O) circuit, all of which may be interconnected. It should further be appreciated that the controller may include multiple microprocessors. Similarly, the memory of the controller may include multiple RAMs and multiple program memories depending on the complexity and requirements of a specific implementation. It should also be appreciated that the I/O circuit may include a number of different types of I/O circuits, such as light-generation circuits, sound-generation circuits, and the like. The RAMs, ROMs and program memories may be implemented as semi-conductor memories, magnetically readable memories, and/or optically readable memories, for example. Moreover, the sound generator 116 may include a speaker or other mechanical, or electro-mechanical device capable of outputting a desired sound in response to signals received from the sound generator 116. Other configurations of sound generating mechanisms may be used or may prove suitable.

In operation, it will be appreciated that, in response to movement of the toy lawn mower 20 in either a forward or rearward direction, the body section 30 shifts between a plurality of positions such that the body section 30 appears to simulate a "chomping" action. It will also be appreciated that the body section 30, when disposed in the exemplary first shifted position of FIG. 5, will be disposed both forward and rotated (rotated in a clockwise position about the pivot 62) relative to the unshifted position of FIG. 4. Further, it will be appreciated that, in response to continued rotation of the wheels 28, the body section 30 will shift to a second shifted position in which the body section 30 is once again generally parallel to the planar receiving area, but the body section 30 is disposed well forward compared to its one shifted position of FIG. 4. Finally, in response to still further rotation of the wheels 28, the body section 30 will shift back toward its original unshifted position, as illustrated in FIG. 7.

It will be appreciated that, in accordance with the disclose the example, by virtue of the face 31 moving back and forth as described above, the face 31 of the toy lawnmower 20 will appear to mimic a "chomping" action. This animated "chomping" action may be enhanced by the inclusion of the teeth 34, 36 as well as the eyes 35. Other animated features may be included as desired so as to further enhance or complement this "chomping" action. Moreover, the sounds generated by the sound generator may be selected so as to mimic or complement the desired "chomping" action and may include, for example, chomping or chewing sounds, mowing sounds, words or phrases which may be related to chewing, eating, and/or mowing, and any other suitable sounds.

The preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A toy lawn mower comprising:

a chassis supported by a plurality of rotatable wheels;

a non-linear guide track operatively coupled to the chassis;

an animated figure including an arm operatively engaging the guide track and arranged to shift along a path between a plurality of positions;

a drive train responsive to movement of one of the rotatable wheels;

a drive lever operatively interconnecting the drive train to the animated figure, the drive lever arranged to reciprocate back and forth along a path disposed in a vertical plane, the animated figure movable to the plurality of positions in response to movement of the drive lever.

2. The toy lawn mower of claim 1, wherein the guide track is arranged so that the plurality of positions includes an unshifted position in which the animated figure is disposed toward a rear end of the chassis and a first shifted position in which the animated figure is rotated about a transverse horizontal axis and shifted toward a front end of the chassis, the animated figure comprising a face arranged to simulate a chomping action as the animated figure proceeds between the plurality of positions.

3. The toy lawnmower of claim 2, wherein the guide track is further arranged so that the plurality of positions includes a second shifted position in which a lower plane of the animated figure is disposed parallel to an upper plane of the chassis with the animated figure disposed toward the front end of the chassis.

4. The toy lawn mower of claim 1, wherein the drive train includes a V lever, the V lever arranged to shift in a first direction in response to movement of the toy lawn mower in a forward direction, the lever arranged to shift in a second direction in response to movement of the toy lawn mower in a rearward direction.

5. The toy lawn mower of claim 4, wherein the V lever carries a first drive gear and a second drive gear, the first drive gear arranged to engage the drive train in response to movement of the V lever in the first direction, the second drive gear arranged to engage the drive train in response to movement of the V lever in the second direction.

6. The toy lawn mower of claim 5, wherein V lever and the first and second drive gears are arranged so that the arm moves along the guide track in a first direction when the first drive gear engages the drive train and when the second drive gear engages the drive train.

7. The toy lawn mower of claim 1, including a sound generator mounted to the chassis and arranged for connection to a power source, and including an actuator arranged to activate the sound generator, the sound generator arranged to generate sounds complementing the action of the animated figure.

8. The toy lawn mower of claim 7, including a lever mounted to the chassis and responsive to movement of at least one of the wheels, the lever arranged to contact the actuator.

9. The toy lawn mower of claim 1, including a chamber mounted to the chassis and arranged to house simulated grass clippings and further including an agitator bar mounted to the chassis, the agitator bar responsive to movement of at least one of the wheels.

10. The toy lawn mower of claim 1, wherein a portion of the chassis includes a generally planar receiving area and wherein a bottom portion of the animated figure is generally planar, the drive train arranged so that the animated figure is over and generally parallel to the receiving area when the animated figure is in the unshifted position, the drive train further arranged so that a forward portion of the animated figure is raised above the receiving area and disposed forwardly of the receiving area when the animated figure is shifted to a first shifted position.

11. The toy lawn mower of claim 10, wherein the drive train is arranged to shift the animated figure along a horizontal path as the animated figure shifts from the first shifted position to a second shifted position.

12. A toy lawn mower comprising:

a chassis having a first end and a second end and supported by a plurality of rotatable wheels;

an animated figure mounted to the chassis, the animated figure arranged to shift between an unshifted position in which the animated figure is disposed toward the first end and a first shifted position in which the animated figure is rotated about a pivot point and the pivot point and the animated figure are shifted forward along a line toward the second end; and a drive train operatively coupling the animated figure to at least one of the wheels such that the animated figure is movable between the unshifted position and the first shifted position in response to rotation of the at least one wheel, wherein the chassis includes a guide track and the animated figure includes an arm sized to engage the guide track.

13. The toy lawn mower of claim 12, wherein the animated figure comprises a face, the animated figure further shiftable to a second shifted position, and wherein the drive train also is arranged to shift the animated figure to the second shifted position.

14. The toy lawn mower of claim 12, including a sound generator mounted to the chassis and arranged for connection to a power source and an actuator arranged to activate the sound generator, and further wherein the animated figure comprises a face, the sound generator arranged to generate a plurality of sounds at least some of which are selected to complement the motion of the animated figure.

15. The toy lawn mower of claim 14, including a lever mounted to an axle, the lever arranged to contact the actuator in response to movement of the toy lawn mower over a support surface.

16. The toy lawn mower of claim 12, including a chamber mounted to the chassis and arranged to house simulated grass clippings and further including an agitator bar, the agitator bar mounted to the chassis and arranged to agitate the clippings in response to movement of the toy lawn mower over a support surface.

17. The toy lawn mower of claim 12, wherein a top portion of the chassis includes a receiving area, the drive train arranged so that the animated figure is disposed over the receiving area when the animated figure is in the unshifted position, the drive train further arranged so that at least a part of the animated figure is raised above the receiving area and is moved toward one of the ends when the animated figure is shifted to the first shifted position, wherein the movement of the animated figure between the positions simulates a chomping action.

18. The toy lawn mower of claim 17, wherein the drive train is arranged to shift the animated figure to a second shiftable position, and wherein the receiving area includes a horizontal surface, the animated figure arranged to slide along the horizontal surface in response to movement of the animated figure from the second shifted position toward the unshifted position.

19. The toy lawn mower of claim 12, wherein the guide track is arranged so that the animated figure simulates a chomping action as the animated figure moves between the shifted and unshifted positions.

20. A toy lawn mower comprising:

a chassis supported by a plurality of rotatable wheels;

a body section mounted atop the chassis;

a non-linear, stationary guide track mounted inside the chassis;

the body section including an arm operatively engaging the guide track;

a drive train responsive to movement of one of the rotatable wheels;

a drive lever operatively interconnecting the drive train and the body section, the drive lever arranged to reciprocate forward and rearward in response to movement of the drive train, the body section movable to the plurality of positions in response to movement of the drive lever; and wherein the guide track is arranged to define an unshifted position in which the body section is disposed toward a rear end of the chassis, a first shifted position in which the body section is rotated about a transverse horizontal axis and is shifted toward a front end of the chassis, and a second shifted position in which a lower plane of the body section is disposed parallel to an upper plane of the chassis with the body section disposed toward the front end of the chassis.

* * * * *